US008311429B2

(12) United States Patent
Okumura

(10) Patent No.: US 8,311,429 B2
(45) Date of Patent: Nov. 13, 2012

(54) IMAGE FORMING APPARATUS HAVING DEVELOPMENT BIAS VOLTAGE GENERATING CIRCUIT

(75) Inventor: Yasuhiko Okumura, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 374 days.

(21) Appl. No.: 12/179,449

(22) Filed: Jul. 24, 2008

(65) Prior Publication Data

US 2009/0028593 A1 Jan. 29, 2009

(30) Foreign Application Priority Data

Jul. 25, 2007 (JP) ..... 2007-192903

(51) Int. Cl.
*G03G 15/06* (2006.01)
*G03G 15/08* (2006.01)

(52) U.S. Cl. ..... 399/55; 399/285

(58) Field of Classification Search ..... 399/55
See application file for complete search history.

(56) References Cited

U.S. PATENT DOCUMENTS 5,638,012 A * 6/1997 Hashimoto et al. ..... 327/110
6,163,663 A * 12/2000 Shinohara et al. ..... 399/55
6,219,499 B1 * 4/2001 Hayashi ..... 399/55
6,980,856 B2 * 12/2005 Sullivan et al. ..... 607/4
7,755,312 B2 * 7/2010 Hirata ..... 318/400.29
2003/0085737 A1 * 5/2003 Tinsley et al. ..... 326/86
2003/0090828 A1 * 5/2003 Venca et al. ..... 360/61
2003/0103364 A1 * 6/2003 Alfrey ..... 363/98
2004/0207453 A1 * 10/2004 Kernhof et al. ..... 327/424
2005/0141120 A1 * 6/2005 Kuehlwein et al. ..... 360/67
2005/0276623 A1 * 12/2005 Suzuki et al. ..... 399/55
2008/0204914 A1 * 8/2008 Hashizume ..... 360/46
2009/0010666 A1 * 1/2009 Okuno et al. ..... 399/55
2009/0167219 A1 * 7/2009 Imai et al. ..... 318/400.11

FOREIGN PATENT DOCUMENTS

JP 06-138755 A 5/1994
JP 2007097388 A * 5/2006

* cited by examiner

*Primary Examiner* — Walter L Lindsay, Jr.
*Assistant Examiner* — David Bolduc
(74) *Attorney, Agent, or Firm* — Canon U.S.A., Inc. IP Division

(57) ABSTRACT

An image forming apparatus includes a charging device to electrically charge a photosensitive member, an exposure unit to expose the charged photosensitive member to light, a development device to develop, with a developer, a latent image formed on the photosensitive member by the exposure unit, and a development bias voltage generating circuit to apply a development bias voltage to the development device. The development bias voltage generating circuit includes a transformer, a capacitor connected to one end of the transformer, first-fourth switching elements, a power source to supply a voltage to the first and third switching elements, and a control unit to control an on and off action of the first to fourth switching elements and independently control the voltages applied by the power source to the first and third switching elements.

4 Claims, 12 Drawing Sheets

IMAGE FORMING APPARATUS HAVING DEVELOPMENT BIAS VOLTAGE GENERATING CIRCUIT

BACKGROUND OF THE INVENTION

1. Field of the Invention

The present invention relates to a development bias voltage generating circuit in an electrophotographic image forming apparatus.

2. Description of the Related Art

Generally, in a development device included in an electrophotographic or electrostatic-recording type image forming apparatus, a one-component developer chiefly composed of magnetic toner or a two-component developer chiefly composed of non-magnetic toner and a magnetic carrier is used. Specifically, in a color image forming apparatus that forms a full-color image by electrophotographic process, almost every development device uses a two-component developer from a viewpoint of color of images.

In a development process by the development device in the image forming apparatus, a high voltage having an AC voltage superposed on a DC voltage is applied to a developer bearing member to develop an electrostatic latent image on an image bearing member with a developer on the developer bearing member.

However, it is confirmed that when a high voltage is applied to a development gap (a gap between a photosensitive drum and a development sleeve), a ring or a spot pattern as illustrated in FIGS. 8A and 8B (hereinafter, referred to as a ring mark) is generated on a recording paper. FIG. 8A illustrates a ring mark formed in a background area of an image and FIG. 8B illustrates a ring mark formed in an image area. Such ring marks seriously degrade an image quality.

A generation mechanism of ring marks is as follows. As a process of image forming on recording paper is repeated in the image forming apparatus, metallic particles from the development sleeve surface scraped by the carrier and from the metal screws enter into the development device due to vibrations during the operation of image forming apparatus. When the metallic foreign particles enter the development device, the development gap is narrowed, so that an electric discharge occurs between the metallic particles and the photosensitive drum surface and the ring marks is generated.

Considering such a principle of generation of the ring marks, it has been confirmed that it is effective to reduce a positive voltage Vp+ of a development AC voltage illustrated in FIG. 9 for suppressing the ring marks that is generated in the background area. FIG. 9 illustrates surface potentials of the photosensitive drum and movement of the developer. Vdark indicates the surface potential of an area not exposed (not developed) by an exposure unit on the uniformly charged photosensitive drum, and Vlight indicates the potential of a latent image formed by the exposure unit. Vdc indicates a DC potential applied to the development sleeve which serves as the developer bearing member, by a development DC voltage generator, and the Vp+ and Vp− indicate amplitude potentials of an AC voltage applied to the development sleeve by a development AC voltage generator.

A potential difference Vcontrast between the potentials Vdc and Vlight influences a development density, namely, a density of a visible image, and a potential difference Vback between the potentials Vdark and Vdc prevents an unexposed area from being developed (fogging prevention). When the potential Vp+ is reduced, the potential difference between the potentials Vdark and Vp+ is reduced, and as a result, the ring marks are decreased.

If a high-density area and a low-density area are adjacent to each other, the developer which should normally adhere to a latent image in the low-density area sometimes adheres to the latent image in the high-density area, or the area which should be developed is not developed, and a phenomenon in which a part of the image is missing (hereinafter, referred to as a pinhole) occurs. As to this phenomenon, it is known that if an absolute value of the potential Vp− increases, the potential difference from the potential Vlight increases, and therefore the latent image in the low-density area is also developed with high accuracy.

Since an AC voltage is applied to the development sleeve, an electric field Vp− in a direction that transfers the developer from the development sleeve to the photosensitive drum and a electric field Vp+ in a direction that returns the developer from the photosensitive drum to the development sleeve are applied alternately, thus a force is exerted to swing the developer.

Therefore, development unevenness can be reduced without depending on the potential difference between the potentials Vdc and Vlight, and developing ability is stabilized. However, a pinhole may be generated in the developer unless some measures are taken. It is known that the developing ability is improved by providing an idle period (a blank period), namely a certain period in which the AC voltage is not applied to the development sleeve, between pulse trains acting as a development bias voltage.

Alternatively, a developing bias voltage with a pulse waveform (FIG. 10) is applied in which a time length to output a positive voltage Vp+ (a positive pulse width) is different from a time length to output a negative voltage Vp− (a negative pulse width). In addition, an absolute value of the voltage Vp+ is smaller than that of the voltage Vp−, the blank periods are provided, and a duty ratio is not 50%. When the bias voltage with such a pulse waveform is applied, the developing ability can be also improved. The waveform as illustrated in FIG. 10 is referred to as a lopsided duty ratio-blank pulse waveform. As a method for outputting the lopsided duty ratio blank pulse waveform, conventionally, a high-voltage transistor is utilized as illustrated in FIG. 11 (Refer to Japanese Patent Application Laid-Open No. 06-138755).

In this method, to generate two kinds of high-voltage DC voltage, two boosting and smoothing circuits 1001 and 1002 are required. Further, in a high-voltage switch circuit, an isolation transformer and a high-voltage transistor need to be provided for both a positive and a negative high voltages for switching operation. The high voltage parts having different potentials need to be separated from each other by a given distance or more to prevent leakage of high voltage. Consequently, a problem arises that a number of parts increases, which leads to increase of sizes and costs of circuit boards. Since the high-voltage transistor is expensive, the two high-voltage transistors are in practice arranged in series to secure a required high voltage state.

Conventionally, as illustrated in FIG. 12, a blank pulse waveform is generated which applies a square waveform with a duty ratio of 50% at regular periodic intervals (hereinafter, referred to as a 50% duty ratio blank pulse waveform). As illustrated in FIG. 13, there is another conventional method which is used to shape the AC voltage waveform of a continuous AC waveform with no blank period. This AC voltage waveform has a duty ratio other than 50% and is shaped on a primary side of a high voltage transformer. In this method, high-voltage AC waveform is generated without using a high-voltage transistor.

As a circuit configured to output the 50% duty ratio blank pulse waveform, an H-bridge circuit that uses a primary winding of the transformer as its load as illustrated in FIG. 14 is known. In a circuit illustrated in FIG. 14, a control unit 1000 outputs an ON signal to switching elements Q1 and Q4 at predetermined timing to apply a voltage Vp+ to a development sleeve 4-1. Then, the control unit 1000 outputs an ON signal to switching elements Q3 and Q2 to apply a voltage Vp− to the development sleeve 4-1. Further, the control unit 1000 outputs an ON signal to the switching elements Q1 and Q3 to generate a voltage of 0 V.

However, in the circuit in FIG. 14, sometimes, command values other than the duty ratio of 50% are necessary. For example, when a pulse waveform in which the ratio between Vp+ output time and Vp− output time is 70:30 (hereinafter, referred to as 70% duty ratio) is output, a magnetic flux ΔB is generated in a transformer T1 when one cycle of the pulse waveform has been output. Since there is no time period for resetting the magnetic flux ΔB, the magnetic flux is incremented by ΔB each time one cycle of the pulse waveform is output, and it will reach magnetic saturation before long. Therefore, it is difficult to use waveforms with a duty ratio other than 50%.

As a circuit to output a continuous AC waveform with a duty ratio other than 50%, in a conventional circuit, a capacitor C1 is inserted in series with the primary winding of the load transformer T1 in the H-bridge circuit as illustrated in FIG. 15. When a 70% duty ratio pulse waveform is output in this circuit, a potential difference across the capacitor C1 is four-tenth of a power supply voltage (Vin) (4/10 Vin V) in a steady state. Therefore, a voltage across the primary winding of the transformer T1 is 3/10 Vin V when the switching elements Q1, Q4 are ON and −7/10 Vin V when the switching elements Q3, Q2 are ON. At this time, a voltage amplitude of 30:70 is generated while an ON time ratio of an applied pulse is 70:30. Thus, the magnetic flux is reset at the end of each cycle, and the continuous AC waveform with 50% duty ratio can be output permanently.

However, if a pulse with a blank period is applied, the potential difference across the capacitor C1 is smoothened, including the blank period in which a voltage 0V is applied. Thus, the potential difference inevitably becomes lower than 4/10 Vin V. As a result, it is impossible to obtain desirable voltages Vp− and Vp+, and only waveforms that depend on the length of the blank periods can be obtained.

SUMMARY OF THE INVENTION

The present invention is directed to an image forming apparatus which has an inexpensive structure and is capable of applying a development bias voltage in a pulse waveform with blank periods and a duty ratio other than 50%.

According to an aspect of the present invention, the image forming apparatus comprises a charging device configured to electrically charge a photosensitive member, an exposure unit configured to expose the electrically charged photosensitive member to light, a development device configured to develop, with a developer, a latent image formed on the photosensitive member by the exposure unit and a development bias voltage generating circuit configured to apply a development bias voltage to the development device. The development bias voltage generating circuit includes a transformer, a capacitor connected to one end of a primary winding of the transformer, a first switching element configured to switch on and off a voltage applied to the other end of the primary winding of the transformer, a second switching element connected to a point between the other end of the primary winding of the transformer and the ground, a third switching element configured to switch on and off a voltage applied to the one end of the primary winding of the transformer via the capacitor, a fourth switching element connected to a point between the capacitor and the ground, a power source configured to supply a voltage to the first switching element and the third switching element, and a control unit configured to control an on and off action of the first to the fourth switching elements and independently control the voltages applied by the power source to the first switching element and the third switching element.

Further features of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate embodiments of the invention and, together with the description, serve to explain the principles of the invention.

DETAILED DESCRIPTION OF THE EMBODIMENTS

Embodiments of the invention will be described in detail below with reference to the drawings.

First Exemplary Embodiment

Figure 1:
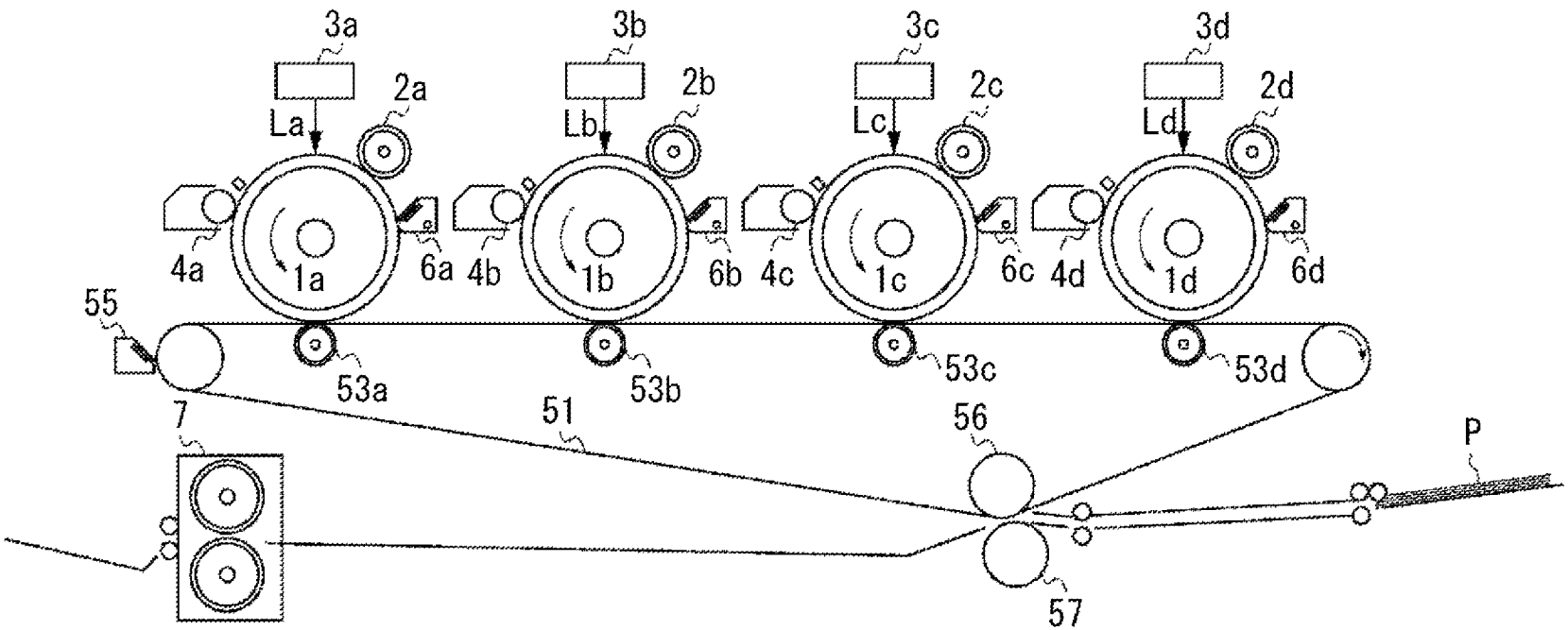
FIG. 1 is a diagram illustrating a configuration of an image forming unit of an image forming apparatus.

FIG. 1 is a diagram illustrating an image forming apparatus installed in an electrophotographic process according to a first exemplary embodiment. The image forming apparatus includes four image forming stations for yellow, magenta, cyan, and black. In FIG. 1, the letters "a" through "d" assigned at the end of reference numerals correspond to the respective image forming stations for yellow, magenta, cyan, and black. Therefore, hereinafter, in the detailed description, those letters "a" through "d" are omitted. The image forming apparatus includes photosensitive members 1 as image carriers, primary charging devices 2, exposure units 3, development devices 4, primary transfer rollers 53, cleaners 6, an intermediate transfer belt 51, an intermediate transfer belt cleaner 55, and secondary intermediate transfer rollers 56 and 57.

After the photosensitive members 1 are uniformly charged by the primary charging devices 2, the photosensitive members 1 are exposed by the exposure units 3 according to image signals and electrostatic latent images are formed on the photosensitive members 1. Then, toner images are developed by the development devices 4. The toner images on the four photosensitive members 1 are transferred and superimposed each other on the intermediate transfer belt 51 by the primary transfer rollers 53.

The toner images transferred on the intermediate transfer belt 51 are transferred onto a recording medium P by the secondary transfer rollers 56 and 57. The toner not transferred and remaining on the photosensitive members 1 is collected by the cleaners 6, and the toner not transferred and remaining on the intermediate transfer belt 51 is collected by the intermediate transfer belt cleaner 55. The toner images transferred to the recording medium P are fixed by a fixing device 7.

Figure 2:
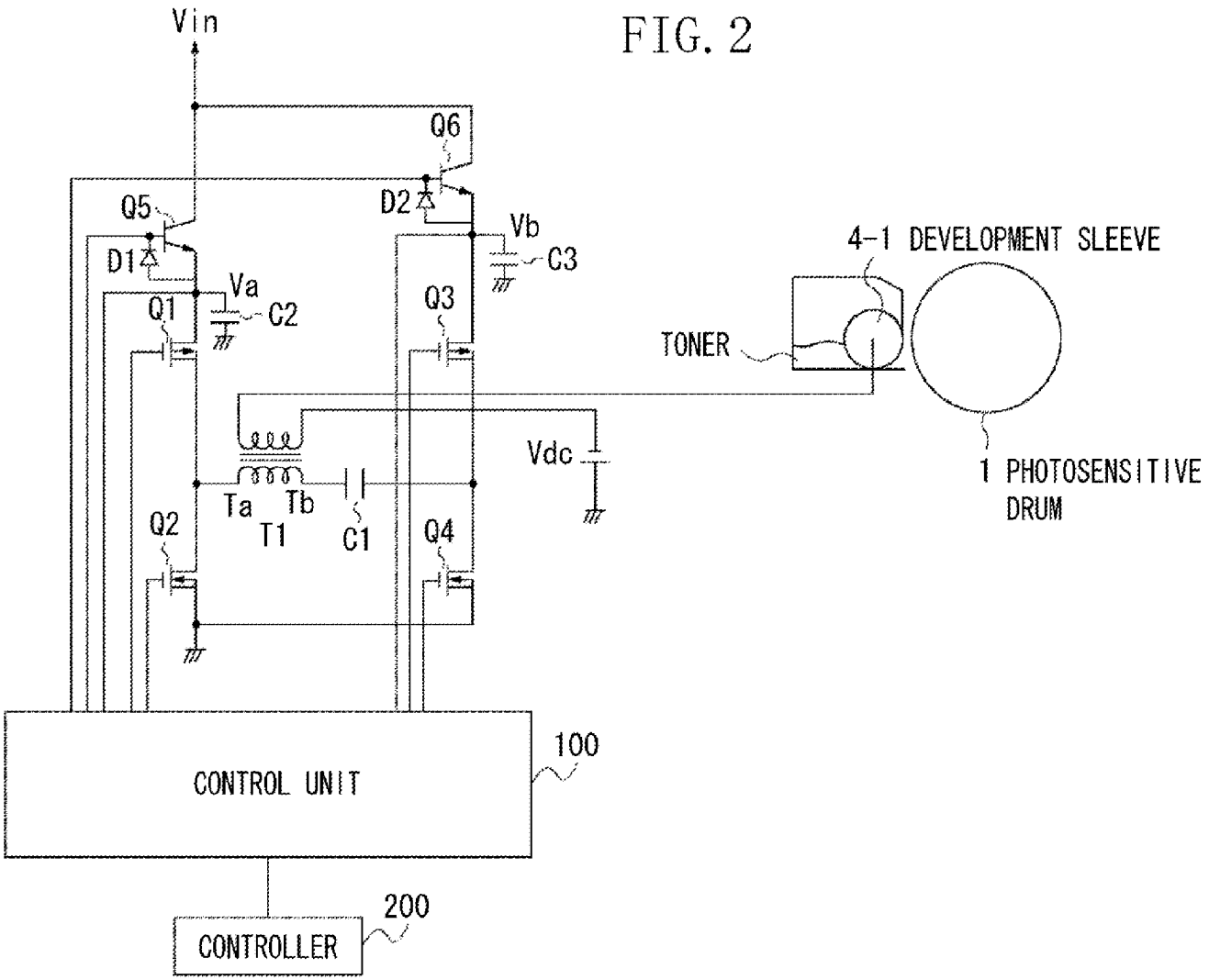
FIG. 2 is a diagram illustrating a development AC voltage generating circuit in a first exemplary embodiment of the present invention.

FIG. 2 is a diagram illustrating a development AC voltage generating circuit that functions as a development bias voltage generating circuit. Vin is a drive power source that supplies a voltage of 24V to the development bias voltage generating circuit. Switching elements Q1, Q2, Q3, and Q4 include a field-effect transistor (FET) and function as electronic switches for an H-bridge circuit. The H-bridge circuit has a primary winding of a transformer T1 and a capacitor C1 as its load. The capacitor C1 connected to one end Tb of the transformer T1 has a function to absorb an imbalance between positive and negative values of an AC voltage, which will be described below.

The switching element Q1 serves as a first switching element to turn on and off a voltage applied to the other end Ta of the primary winding of the transformer T1. The switching element Q2 is connected to a point between the other end Ta of the transformer T1 and the ground (GND). The switching element Q2 functions as a second switching element to switch the potential at the other end Ta of the transformer T1 to the reference potential (ground potential). The switching element Q3 functions as a third switching element to turn on and off a voltage applied to the one end Tb of the transformer T1 via the capacitor C1. The switching element Q4 is connected to a point between the capacitor C1 and the ground. The switching element Q4 functions as a fourth switching element that switches the potential at the one end Tb of the transformer T1 to the reference potential (ground potential).

Transistors Q5 and Q6 are driven so that voltages Va and Vb applied from the drive power source Vin to the switching elements Q1 and Q3 become desired values, and function as a first voltage control element and a second voltage control element. The transistors of the switching elements Q1 and Q2 are driven in regions where they have linear output characteristics. Capacitors C2 and C3 stabilize the emitter voltages Va and Vb of the transistors of the switching elements Q1 and Q2, and diodes D1 and D2 control the base-emitter voltages of the transistors of the switching elements Q1 and Q2.

A secondary winding of the transformer T1 has one end connected to a development sleeve 4-1 as a load, and the other end connected to a development DC voltage generating circuit Vdc. By this circuit configuration, a high voltage (AC and DC superimposed voltage) is applied as a development bias voltage to the development sleeve 4-1. The development sleeve 4-1 rotates while bearing a developer including toner and carrier on its outer surface, and the toner adheres to a photosensitive drum 1 by a potential difference from an electrostatic latent image formed on the photosensitive drum 1.

From an upper-level controller 200, a control unit 100 receives command values of voltages Vp− and Vp+ applied to the development sleeve 4-1. The control unit 100 independently controls on and off actions of the switching elements Q1 through Q4, and base voltages of the transistors Q5 and Q6. The control unit 100, according to received command values (Vp+, Vp−), controls the base voltage of the transistor Q5 so that Va, which satisfies a condition n2*Va=n1*Vp+, becomes the same value as the potential of the capacitor C2. Here, n1 denotes a number of turns of the primary winding of the transformer T1 and n2 denotes a number of turns of the secondary winding of the transformer T1.

Figure 10:
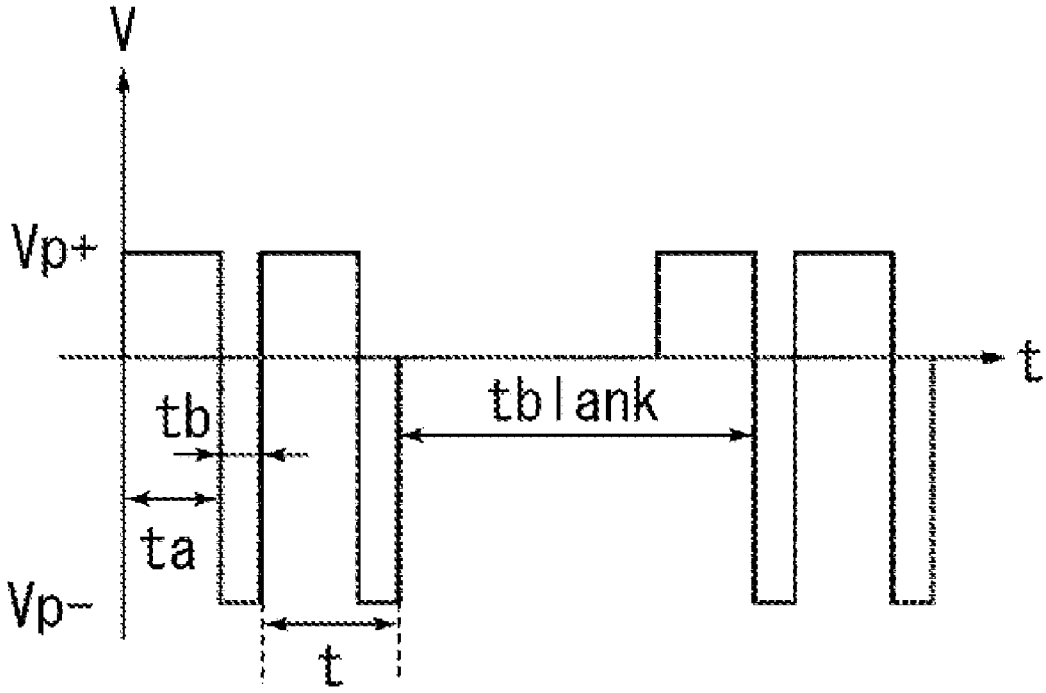
FIG. 10 is a diagram illustrating a lopsided duty ratio blank pulse waveform.
Figure 11:
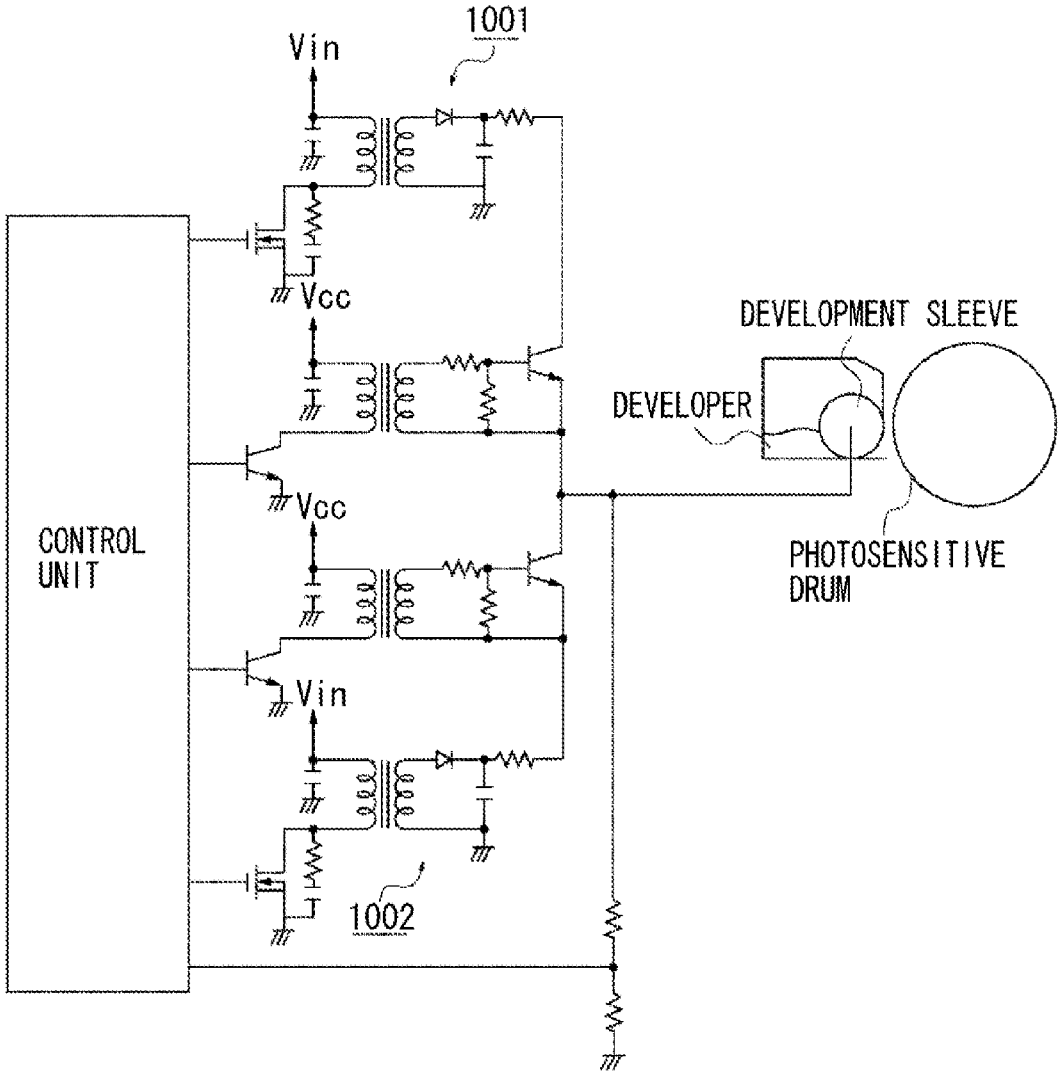
FIG. 11 PRIOR ART
FIG. 11 is a diagram illustrating a conventional lopsided duty ratio blank pulse waveform output circuit.
Figure 12:
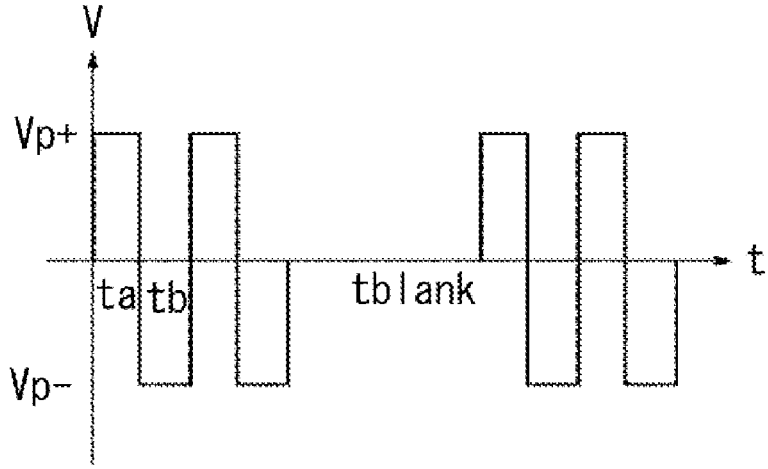
FIG. 12 PRIOR ART
FIG. 12 is a diagram illustrating a 50% duty ratio blank pulse waveform.
Figure 13:
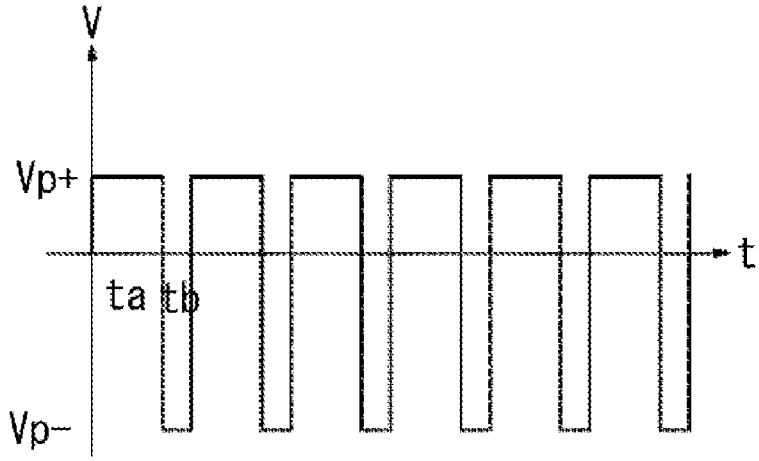
FIG. 13 PRIOR ART
FIG. 13 is a diagram illustrating a lopsided duty ratio pulse waveform.
Figure 14:
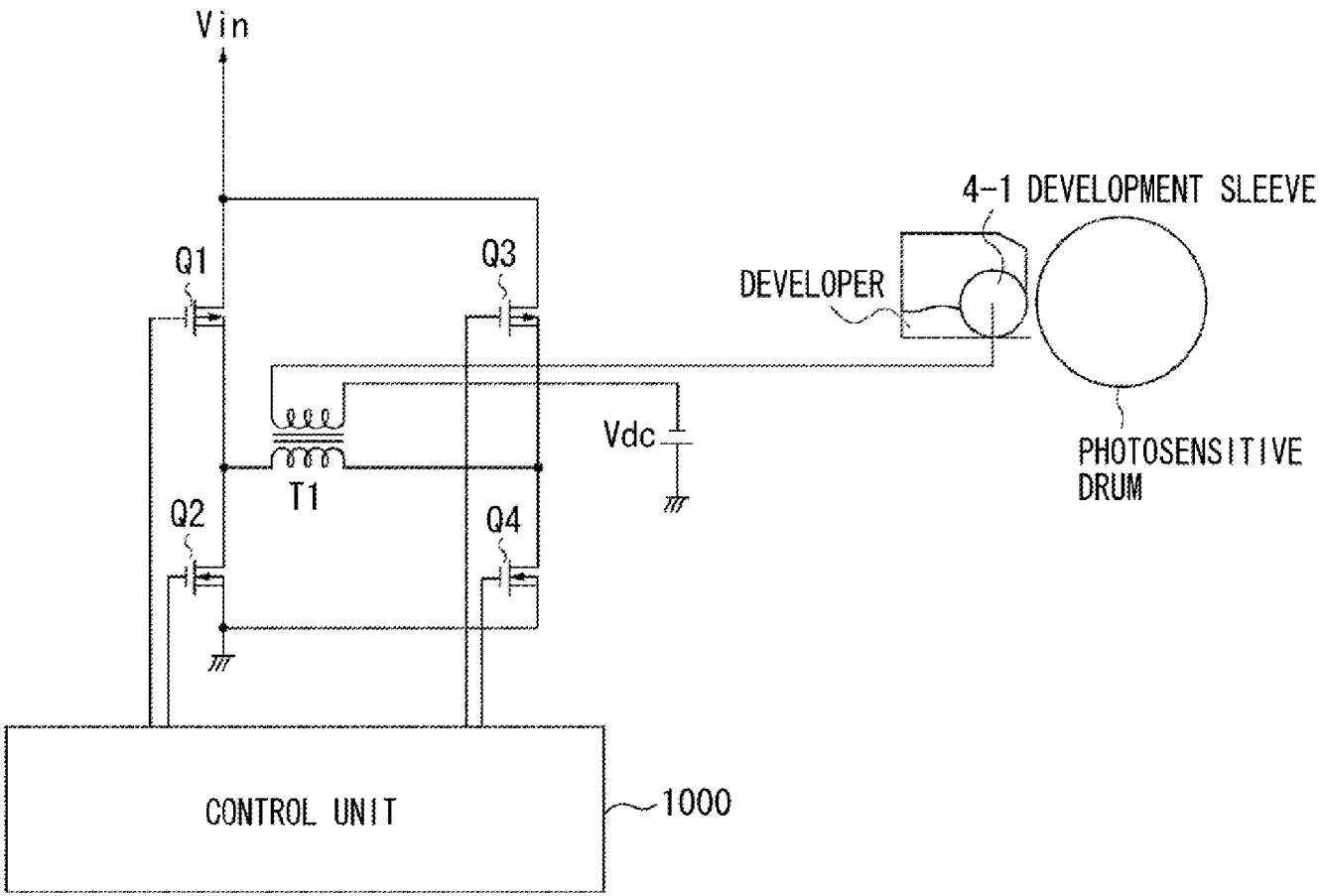
FIG. 14 PRIOR ART
FIG. 14 is a diagram illustrating a conventional 50% duty ratio blank pulse waveform output circuit.
Figure 15:
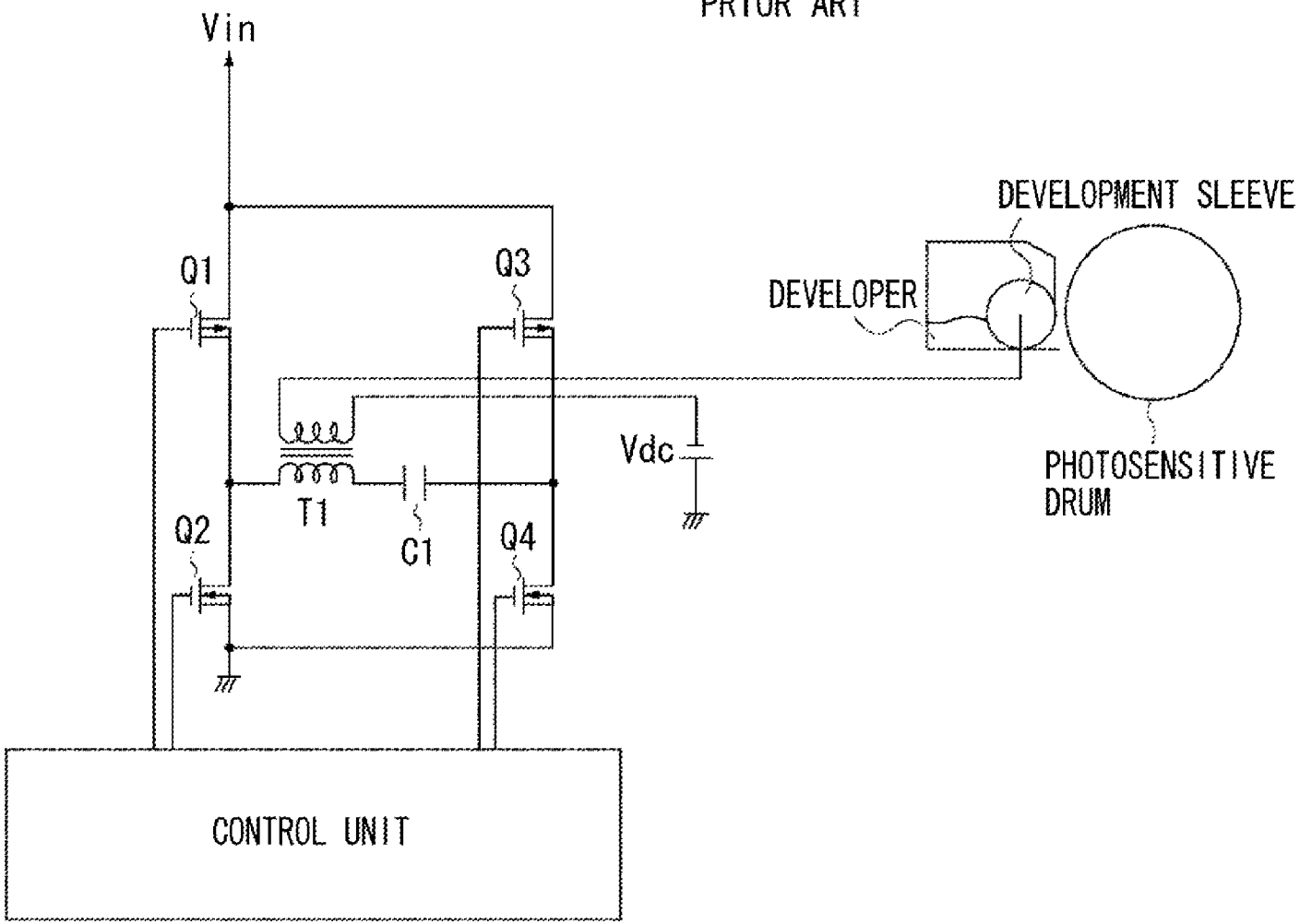
FIG. 15 PRIOR ART
FIG. 15 is a diagram illustrating a conventional lopsided duty ratio pulse waveform output circuit.

Similarly, the control unit 100 controls the base voltage of the transistor Q6 so that Vb, which satisfies a condition n2*Vb=n1*Vp−, becomes the same value as the potential of the capacitor C3. Further, the control unit 100 derives time ta and tb that satisfy Va:Vb (=Vp+:Vp−)=tb:ta and t=ta+tb for a predetermined cycle t of an AC voltage as illustrated in FIG. 10.

More specifically, the control unit 100 calculates the time ta and tb in which a ratio of the voltage Va to the voltage Vb coincides with a ratio of the time tb to the time ta. At the time ta, a voltage is applied from the one end Tb to the other end Ta of the primary winding of the transformer T1. At the time tb, a voltage is applied from the other end Ta to the one end Tb of the primary winding of the transformer T1. The control unit 100 supplies an ON signal at the time ta to gates of the switching elements Q1 and Q4 to bring them into conduction, and supplies an ON signal at the time tb to gates of the switching elements Q3 and Q2 to bring them into conduction. Thus, a square wave with desired peak voltages is generated.

When the control unit 100 supplies an ON signal to the gates of the switching elements Q1 and Q3 only for a blank time of tblank to bring the switching elements Q1 and Q3 into conduction, output of a secondary side of the transformer T1 becomes 0V. In other words, a blank period, in which an AC voltage is not applied to the development sleeve 4-1, can be provided. Even in the blank period, a potential difference of Va−Vb is applied to the capacitor C1. Therefore, even when a square wave is output in a non-blank period, a waveform which is equivalent to a waveform when a continuous square wave is output without a blank period can be obtained.

For example, if Vp+=600 V, Vp−=−900 V, n2/n1=50, t=100 μs are given, Va=12 V, Vb=18 V, ta=60 μs, tb=40 μs are obtained. Thus, a blank pulse waveform with a duty ratio of 60% can be applied to the development sleeve.

According to the first exemplary embodiment of the present invention, as illustrated in FIG. 10, the development sleeve 4-1 can be applied with a square wave voltage which has predetermined blank periods tblank and desired voltages Vp+ and Vp− with the same positive and negative powers (the positive and negative areas of the square wave are equal). This enables accurate development of images.

Second Exemplary Embodiment

A gap between the development sleeve 4-1 and the photosensitive member 1 is a capacitive load in the development voltage generating circuit. Therefore, a generated square wave changes from a target square wave owing to a time constant determined by a limiting resistance and a load capacity inserted in the development voltage generating circuit.

Figure 4:
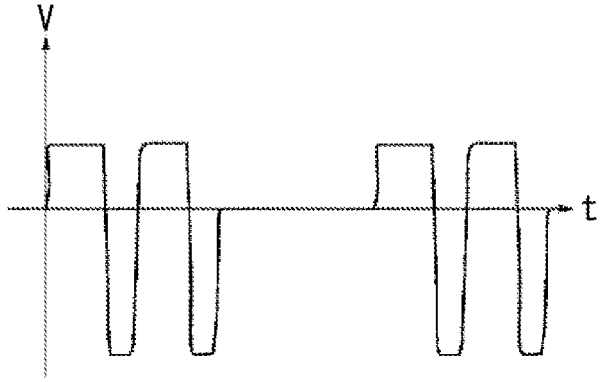
FIG. 4 is a diagram illustrating a lopsided ratio blank pulse waveform.
Figure 5:
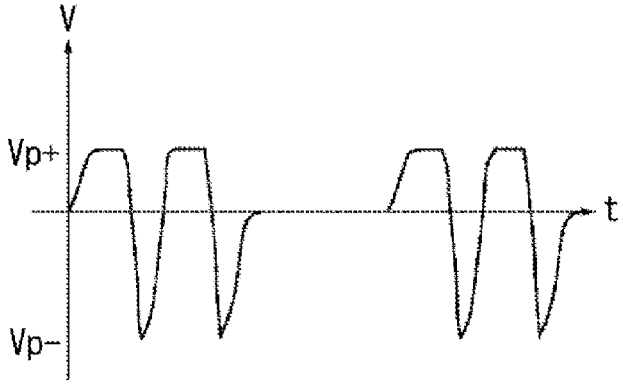
FIG. 5 is a diagram illustrating a lopsided duty ratio blank pulse waveform.

In a case of the development AC voltage generating circuit illustrated in FIG. 2, a generated square wave has a waveform as depicted in FIG. 4, in which a speed at a leading edge and that at a trailing edge of the square wave are different in a precise sense. In practice, the target square wave can be obtained when the capacitor C1 is provided with a capacity large enough for a required load capacity, and a limiting resistance is selected so that slopes of the leading and trailing edges of a square wave come within a tolerable value relative to the load capacitance and the desired voltages Vp+ and Vp−. However, if the capacity varies due to variations of the photosensitive member 1 and the development device 4 at the time of installation, or due to an environmental variation, a desired output voltage may not be obtained under the condition of Va:Vb=tb:ta. In particular, when the load capacity value increases relative to an estimated value, the waveform of Vp−, which is on the negative side is notably deformed (FIG. 5). However, an imbalance between the positive and negative sides of the applied pulse is absorbed by voltage changes in the capacitor C1. Thus, errors are produced in DC components of the development bias voltage.

Figure 3:
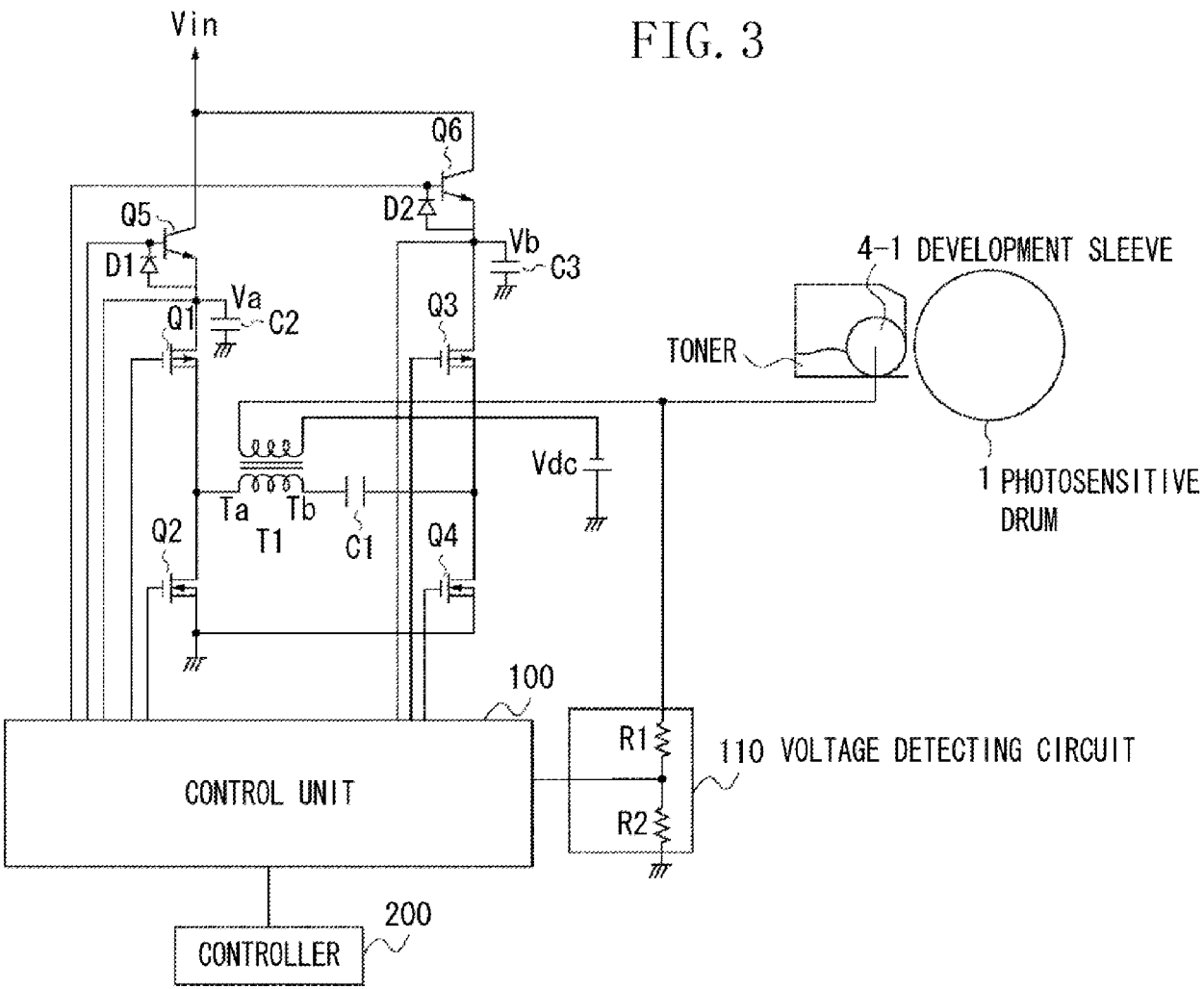
FIG. 3 is a diagram illustrating the development AC voltage generating circuit in a second exemplary embodiment of the present invention.

According to a second exemplary embodiment of the present invention, a development AC voltage generating circuit capable of solving the above problem is provided. FIG. 3 is a diagram illustrating the development AC voltage generating circuit according to the second exemplary embodiment. Electric parts identical with those of the circuit in FIG. 2 are designated by the same reference numerals, and their descriptions are omitted.

A voltage detecting circuit 110 detects an output voltage on the secondary side of the transformer T1, and includes resistances R1 and R2.

Figure 7:
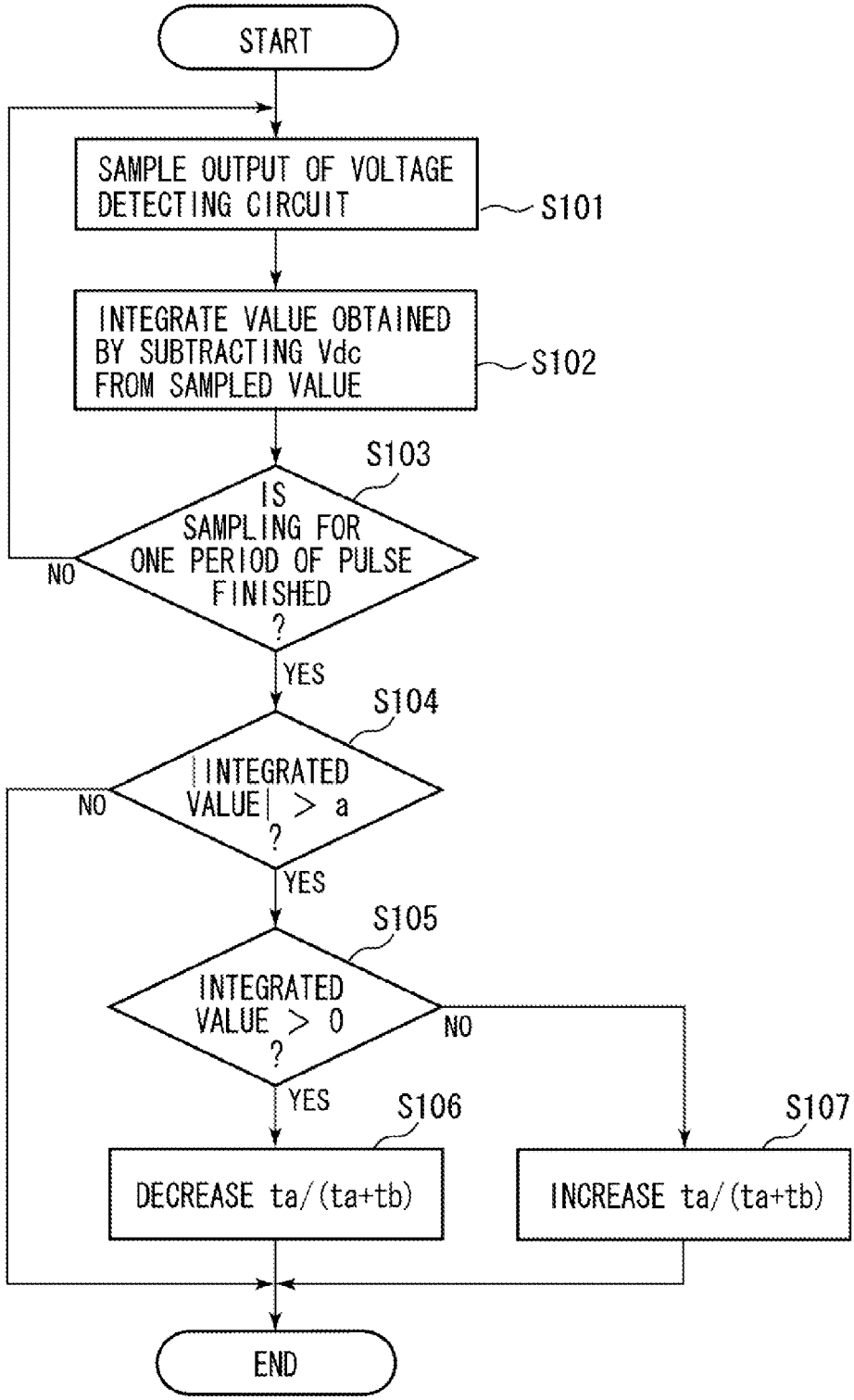
FIG. 7 is a flowchart illustrating a correction process of an applied pulse.
Figure 8A:
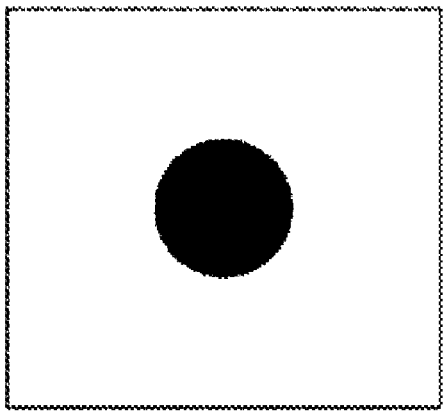
FIG. 8A PRIOR ART
FIGS. 8A and 8B are diagrams illustrating ring marks.
Figure 8B:
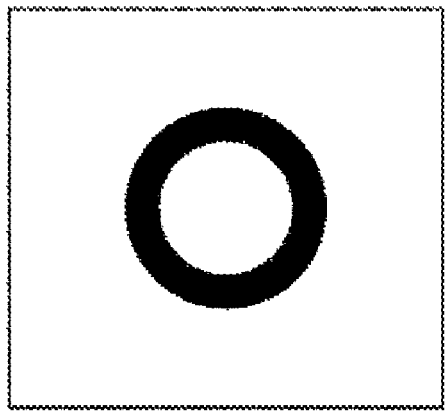
FIG. 8B PRIOR ART
Figure 9:
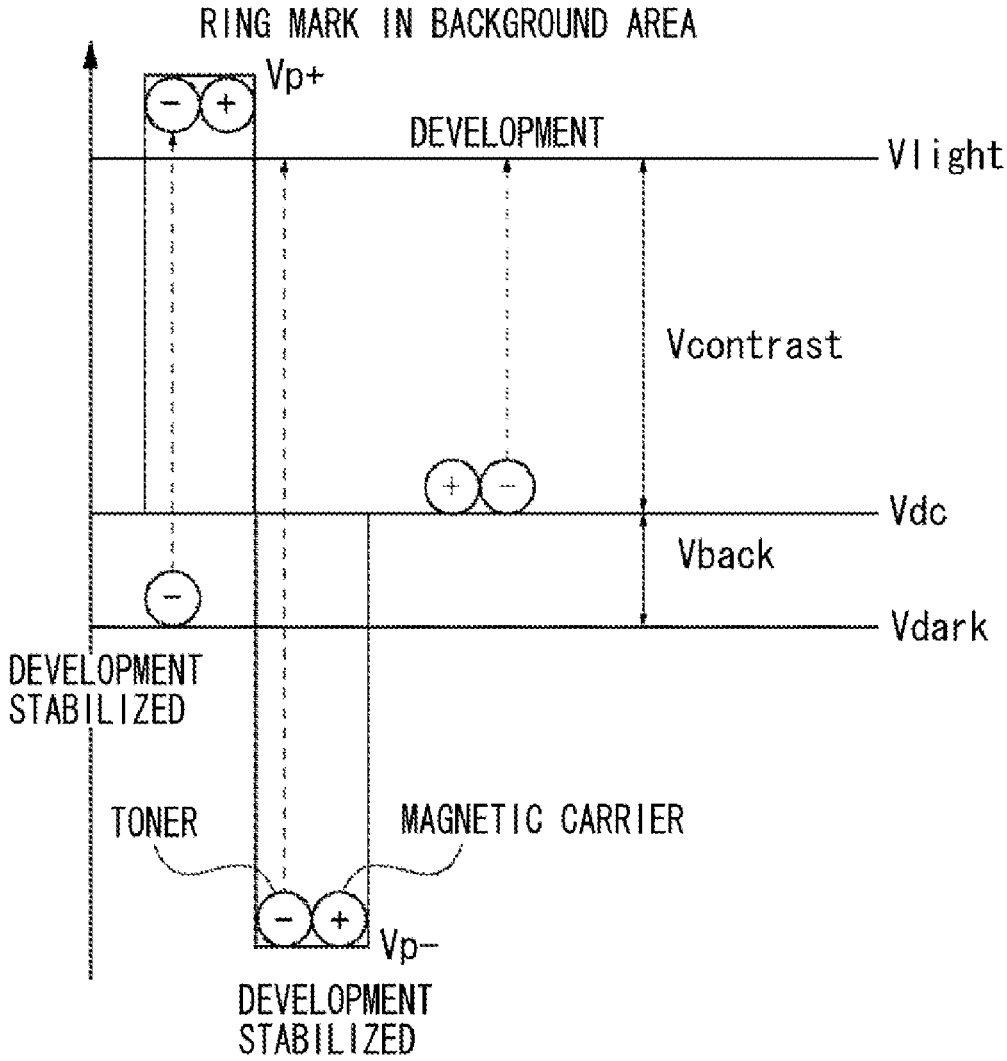
FIG. 9 PRIOR ART
FIG. 9 is a diagram illustrating potentials of a photosensitive drum.

FIG. 7 is a flowchart illustrating a correction process for an applied pulse to the development sleeve 4-1 which is executed by the control unit 100 in FIG. 3. This correction process corrects an imbalance between positive and negative values of a pulse applied to the development sleeve 4-1 and the duty ratio is corrected so that the positive power and the negative power become equal. When use of the image forming apparatus is started or every time images are formed predetermined number of times (10,000 times for example), duty adjustment is performed, which is described below.

In step S101, the control unit 100 samples a voltage output by the voltage detecting circuit 110 at a fixed period, and in step S102, the control unit 100 integrates a value obtained by subtracting a voltage Vdc from a sampled voltage. A sampling period should be short enough compared with one period of a pulse applied to the development sleeve 4-1 (1/10 for example). In step S103, the control unit 100 determines whether integration for one period of the pulse applied to the development sleeve 4-1 is completed. If the integration of one period of the pulse is completed (YES in step S103), the control unit 100, in step S104, determines whether an absolute value of an integrated value is larger than a threshold value "a".

Though a target integrated value is 0 (a positive power value coincides with a negative power value), it is difficult to obtain the target integrated value of 0, so that a permissible threshold value "a" is used. If the absolute value of the integrated value is equal to or less than the threshold value "a" (NO in step S104), the adjustment process is finished. If the absolute value of the integrated value is larger than the threshold value "a" (YES in step S104), the control unit 100, in step S105, determines whether the integrated value for one period is larger than 0. If the integrated value for one period is larger than 0 (YES in step S105), the control unit 100 decreases the value of ta/(ta+tb) in step S106, or if the integrated value for one period is equal to or less than 0 (NO in step S103), the control unit 100 increases the value of ta/(ta+tb) in step S106.

When an AC output Vac of the secondary winding of the transformer T1 is expressed by Vac (t) as a function of time "t", the time ta and tb obtained by the above process are values such that the integration of Vac(t) over one period ta+tb of a pulse is zero. Therefore, a duty ratio is determined to satisfy the following formula, $$\int_0^{ta+tb} Vac(t)dt = 0.$$

Figure 6:
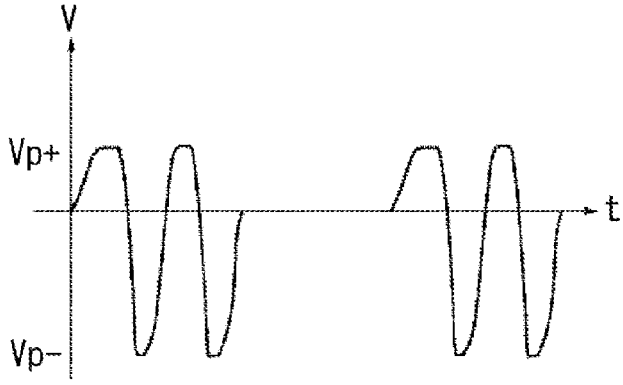
FIG. 6 is a diagram illustrating a lopsided duty ratio blank pulse waveform.

The control unit 100, based on obtained time ta and tb, supplies an ON signal to the gates of the switching elements Q1 and Q4 for a period of the time ta to bring them into conduction, and also supplies an ON signal to the gates of the switching elements Q3 and Q2 for a period of the time tb to bring them into conduction. Therefore, a square wave with desired peak voltages is output to the secondary side of the transformer T1. As an ON signal is supplied to the gates of the switching elements Q1 and Q3 for a predetermined period of blank time tblank to bring them into conduction, the secondary side of the transformer T1 outputs an voltage of 0V. Therefore, the development sleeve 4-1 can be applied with a square wave voltage which has the predetermined blank periods and desired peak values Vp+ and Vp− with the same positive and negative powers of a pulse, as illustrated in FIG. 6. Thus, accurate development of images is achieved.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2007-192903 filed Jul. 25, 2007, which is hereby incorporated by reference herein in its entirety.

What is claimed is:

1. An image forming apparatus comprising:

a charging device configured to electrically charge a photosensitive member;

an exposure unit configured to expose the electrically charged photosensitive member to light;

a development device configured to develop, with a developer, a latent image formed on the photosensitive member by the exposure of the exposure unit; and a development bias voltage generating circuit configured to apply a development bias voltage to the development device, wherein the development bias voltage generating circuit includes:

a transformer configured to output the development bias voltage from a secondary winding;

a capacitor connected to one end of a primary winding of the transformer;

a first switching element configured to switch on and off a voltage applied to the other end of the primary winding of the transformer;

a second switching element connected to a point between the other end of the primary winding of the transformer and the ground;

a third switching element configured to switch on and off a voltage applied to the one end of the primary winding of the transformer via the capacitor;

a fourth switching element connected to a point between the capacitor and the ground;

a power source configured to supply a voltage to the first switching element and the third switching element; and a control unit, connected to respective gates of the first to fourth switching elements, configured to control an on and off action of the first to the fourth switching elements, the control unit further configured to independently control the voltages applied by the power source to the first switching element and the voltages applied by the power source to the third switching element, wherein the control unit controls the on and off action of the first to the fourth switching elements and controls voltages applied to the first and the third switching elements so that a signal is output from the secondary winding of the transformer, wherein the signal has different absolute values as to positive and negative peak voltages and includes blank periods in which no pulse is output between pulse trains whose pulse widths are different as to the positive and negative voltages.

2. The image forming apparatus according to claim 1, wherein the development bias voltage generating circuit includes a first voltage control element connected to the point between the power source and the first switching element, and a second voltage control element connected to the point between the power source and the third switching element, wherein the control unit independently controls the first voltage control element and the second voltage control element.

3. The image forming apparatus according to claim 1, wherein the control unit controls the on and off action of the first to the fourth switching elements and also controls voltages applied to the first switching element and the third switching element so that a ratio between a voltage applied to the first switching element and a voltage applied to the third switching element coincides with a ratio between time length of applying a voltage from one end to the other end and time length of applying a voltage from the other end to the one end of the primary winding of the transformer.

4. The image forming apparatus according to claim 1, wherein when the time length of applying the voltage from one end to the other end of the primary winding of the transformer is represented by tb, the time length of applying the voltage from the other end to the one end of the primary winding of the transformer is represented by ta, and an output voltage of a secondary winding of the transformer is expressed by Vac(t) as function of time t, the control unit controls a ratio between the time lengths ta and tb to satisfy a following formula $$\int_0^{ta+tb} Vac(t)dt = 0.$$

* * * * *